US010304609B2

(12) United States Patent
Wang et al.

(10) Patent No.: US 10,304,609 B2
(45) Date of Patent: May 28, 2019

(54) ENCLOSURE FOR VOLTAGE TRANSFORMER AND CORRESPONDING VOLTAGE TRANSFORMER

(71) Applicant: Siemens Aktiengesellschaft, Munich (DE)

(72) Inventors: Jie Wang, Shanghai (CN); Xiao Hong Zhang, Shanghai (CN)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/027,261

(22) PCT Filed: Dec. 30, 2014

(86) PCT No.: PCT/EP2014/079467
§ 371 (c)(1),
(2) Date: Apr. 5, 2016

(87) PCT Pub. No.: WO2015/101634
PCT Pub. Date: Jul. 9, 2015

(65) Prior Publication Data

US 2016/0300656 A1 Oct. 13, 2016

(30) Foreign Application Priority Data

Dec. 31, 2013 (CN) ..... 2013 2 0891866 U

(51) Int. Cl.
*H01F 27/02* (2006.01)
*H01F 38/38* (2006.01)
*H01F 27/32* (2006.01)

(52) U.S. Cl.
CPC ..... *H01F 27/02* (2013.01); *H01F 38/38* (2013.01); *H01F 27/321* (2013.01)

(58) Field of Classification Search
CPC ..... H01F 27/12; H01F 27/085; H01F 38/12; H01F 27/022
(Continued)

(56) References Cited

U.S. PATENT DOCUMENTS

2004/0085174 A1 5/2004 Decristofaro et al.

FOREIGN PATENT DOCUMENTS

DE 9209167 U1 11/1992
EP 2346128 A1 * 7/2011 ..... H02B 13/0356
(Continued)

OTHER PUBLICATIONS

International Search Report PCT/ISA/210 for International Application No. PCT/EP2014/079467 dated Apr. 13, 2015.
(Continued)

*Primary Examiner* — Tszfung J Chan
(74) *Attorney, Agent, or Firm* — Harness, Dickey & Pierce, PLC

(57) ABSTRACT

An embodiment of the present invention relates to an enclosure for a voltage transformer, including a shell. The shell is provided with a plurality of packaging spaces for packaging bodies of the voltage transformer. Each of the packaging spaces is provided with a closed end and a sealed end, and every two adjacent packaging spaces are in communication with each other. In the enclosure for a voltage transformer of an embodiment of the present invention, the size of the enclosure for a voltage transformer along an arrangement direction is reduced, as a result of which, the entire enclosure for a voltage transformer has a compact structure and a small occupied space. An embodiment of the present invention further relates to a voltage transformer including the above-mentioned enclosure for a voltage transformer.

18 Claims, 3 Drawing Sheets

(58) Field of Classification Search
USPC ..... 336/57, 59, 90, 92, 94, 96
See application file for complete search history.

(56) References Cited

FOREIGN PATENT DOCUMENTS

| | | | | |
|---|---|---|---|---|
| EP | 2346128 | A1 | | 7/2011 |
| JP | 05041325 | A | * | 2/1993 |
| JP | H0935957 | A | | 2/1997 |
| JP | 2004022557 | A | * | 1/2004 |
| JP | 2004022557 | A | | 1/2004 |
| JP | 2006505142 | A | | 2/2006 |
| RU | 2393494 | C1 | | 6/2010 |

OTHER PUBLICATIONS

Written Opinion of the International Searching Authority PCT/ISA/237 for International Application No. PCT/EP2014/079467 dated Apr. 13, 2015.
Japanese Office Action in connection with Application No. 2016-561083 dated Jun. 5, 2017.
Russian Office Action for corresponding Russian Application No. 2016114426 dated Jan. 10, 2018 and English translation thereof.

* cited by examiner

ENCLOSURE FOR VOLTAGE TRANSFORMER AND CORRESPONDING VOLTAGE TRANSFORMER

PRIORITY STATEMENT

This application is the national phase under 35 U.S.C. § 371 of PCT International Application No. PCT/EP2014/079467 which has an International filing date of Dec. 30, 2014, which designated the United States of America and which claims priority to Chinese patent application number CN 201320891866.7 filed Dec. 31, 2013, the entire contents of which are hereby incorporated herein by reference.

FIELD

At least one embodiment of the present invention generally relates to an enclosure for a voltage transformer, in particular to an enclosure, which is used with a voltage transformer for combined use with a high-voltage power system composite apparatus. At least one embodiment of the present invention also relates to a voltage transformer using the enclosure.

BACKGROUND

In a high-voltage power system, a voltage transformer comprises a plurality of bodies and an enclosure for packaging the bodies. The voltage transformer is electrically insulated by an SF6 gas in the enclosure. In addition, the enclosure is also required to have enough structural strength in order to meet explosion prevention requirements for the voltage transformer in use.

A typical enclosure for a voltage transformer has a complex structure, occupies a very large installation space, and has high machining cost for the entire shell.

SUMMARY

The inventors have recognized that there is a need to provide a structurally compact enclosure for a voltage transformer.

The inventors have recognized that there is a further need to provide a voltage transformer using the enclosure.

At least one embodiment of the present invention provides an enclosure for a voltage transformer, which comprises a shell. The shell is provided with a plurality of packaging spaces for packaging bodies of the voltage transformer. Each of the packaging spaces is provided with a closed end and a sealed end, and every two adjacent packaging spaces are in communication with each other. The bodies of the voltage transformer are arranged in adjacent packaging spaces of the shell, so that the size of the enclosure for a voltage transformer along the arrangement direction is reduced, as a result of which, the entire enclosure for a voltage transformer has a compact structure and a small occupied space.

At least one embodiment of the present invention further provides a voltage transformer, which comprises an enclosure for a voltage transformer and a plurality of bodies. The enclosure for a voltage transformer is an enclosure for a voltage transformer such as described above, and the bodies correspond to the packaging spaces and are respectively installed in the packaging spaces. The voltage transformer has a compact structure and a small occupied space.

BRIEF DESCRIPTION OF THE DRAWINGS

The following drawings are provided merely for schematic illustration and explanation of the present invention, without limiting the scope of the invention model.

DETAILED DESCRIPTION OF THE EXAMPLE EMBODIMENTS

Figure 1:
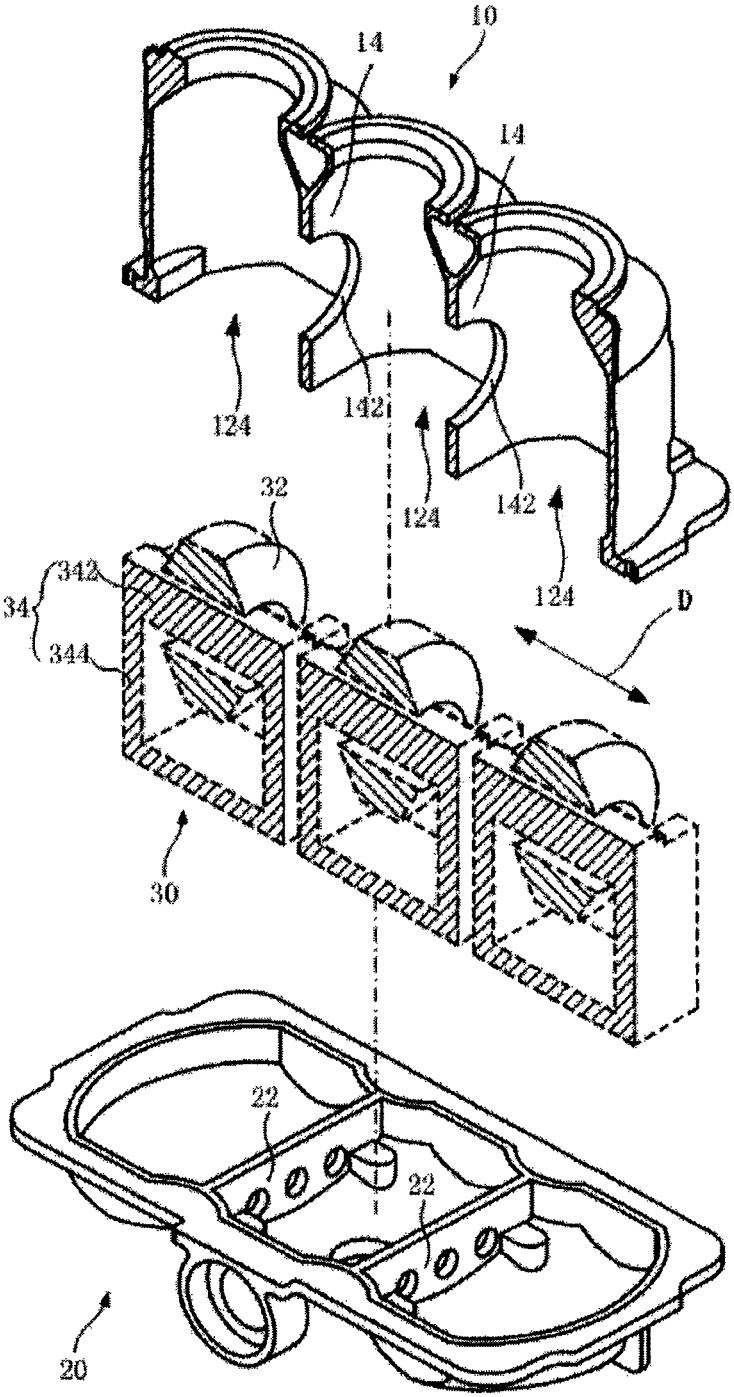
FIG. 1 schematically illustrates the structure of an embodiment of an enclosure for a voltage transformer.

At least one embodiment of the present invention provides an enclosure for a voltage transformer, which comprises a shell. The shell is provided with a plurality of packaging spaces for packaging bodies of the voltage transformer. Each of the packaging spaces is provided with a closed end and a sealed end, and every two adjacent packaging spaces are in communication with each other. The bodies of the voltage transformer are arranged in adjacent packaging spaces of the shell, so that the size of the enclosure for a voltage transformer along the arrangement direction is reduced, as a result of which, the entire enclosure for a voltage transformer has a compact structure and a small occupied space.

In one embodiment of the present invention, the packaging spaces are arranged in a straight line. Due to the arrangement of the packaging spaces in a straight line, the size in a direction perpendicular to the arrangement direction is minimized while the size along the arrangement direction is reduced as much as possible.

In another embodiment of the present invention, a shell reinforcing rib is arranged between every two adjacent packaging spaces. Since every two adjacent packaging spaces are partitioned only by a shell reinforcing rib therebetween, the size of the enclosure for a voltage transformer along the arrangement direction is reduced.

In a still further embodiment of the present invention, each of the shell reinforcing ribs is provided with a communicating hole for communicating two adjacent packaging spaces with each other. The communicating holes enable insulating gas to flow between different packaging spaces.

In a yet further embodiment of the present invention, the enclosure for a voltage transformer further comprises a cover plate, and the cover plate is sealingly connected to the sealed ends of the packaging spaces.

In a yet further embodiment of the present invention, the cover plate is provided with a plurality of cover plate reinforcing ribs corresponding to the shell reinforcing ribs, and the cover plate reinforcing ribs are jointed with the shell reinforcing ribs. By providing the cover plate reinforcing ribs in the cover plate, the mechanical strength of the entire cover plate is enhanced, so that the anti-explosion capability of the cover plate is enhanced.

In a yet further embodiment of the present invention, the cover plate is provided with a gas inlet for introducing an insulating gas.

At least one embodiment of the present invention further provides a voltage transformer, which comprises an enclosure for a voltage transformer and a plurality of bodies. The enclosure for a voltage transformer is an enclosure for a voltage transformer such as described above, and the bodies correspond to the packaging spaces and are respectively installed in the packaging spaces. The voltage transformer has a compact structure and a small occupied space.

In an embodiment of the present invention, each of the bodies is provided with a winding and an iron core, the iron core is provided with an iron core post for mounting the winding and an iron yoke connected to the iron core post, and the iron yoke is shaped like a sheet. Since the iron yoke is shaped like a sheet, the size of the iron yoke in the arrangement direction can be reduced.

In another embodiment of the present invention, the included angle between an extension direction of the iron core post and the arrangement direction is 0, 90 or 45 degrees.

In a further embodiment of the present invention, the voltage transformer is a three-phase voltage transformer.

For better understanding of technical features, objects and effects of the present invention, specific embodiments of the present invention will now be described in detail with reference to the accompanying drawings, in which the same reference numerals refer to the same parts.

Throughout the text, "schematic" represents "serving as an example, instance or description", and any illustration or embodiment described as "schematic" herein should not be interpreted as a more preferred or more advantageous technical solution.

To make the figures look concise, only the parts related to the present invention are schematically shown in the figures, and they do not represent the practical structure of the parts as a product. In addition, to make the figures look concise and easy to understand, in some figures, only one of components with the same structure or function is schematically drawn or referenced.

Throughout the text, the term "a" or "an" represents not only "only one" but also "more than one".

Throughout the text, the value of an angle is not a limit in strictly mathematical and/or geometrical sense(s), and includes an error understood by those skilled in the art and allowed in manufacture or use.

Figure 2:
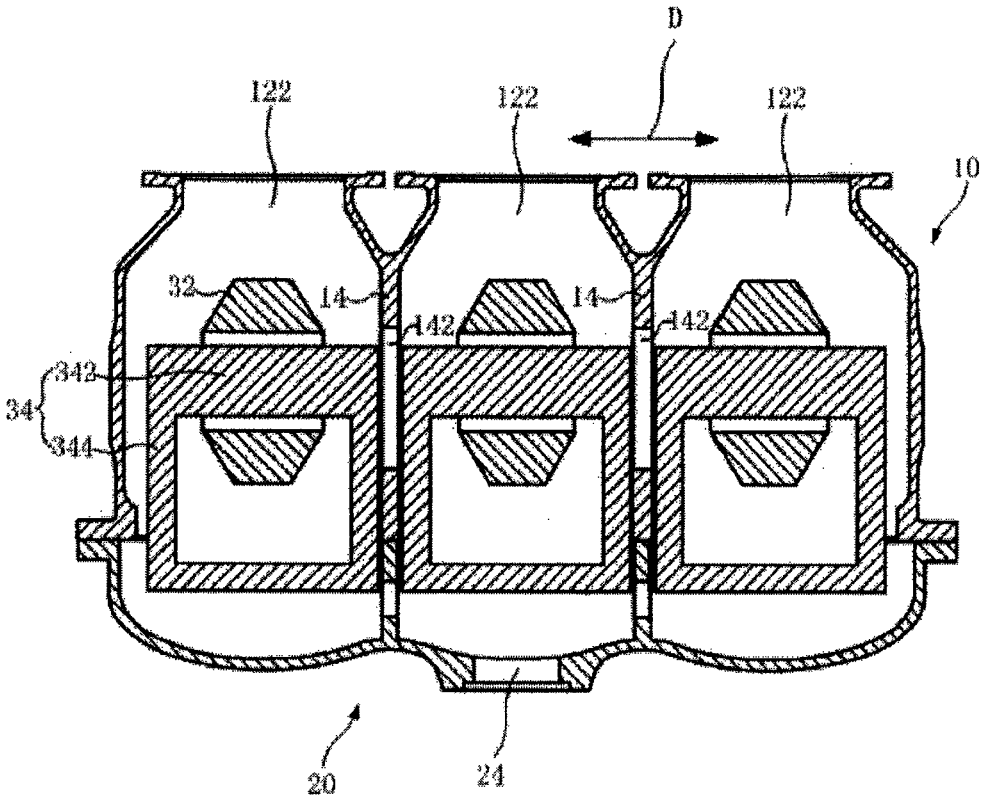
FIG. 2 shows a structural schematic view of an enclosure for a voltage transformer in an assembled state.

FIG. 1 illustrates the structure of a schematic embodiment of an enclosure for a voltage transformer. FIG. 2 shows a structural schematic view of an enclosure for a voltage transformer in an assembled state. FIG. 1 shows the bodies of a voltage transformer with dotted lines. Referring to FIGS. 1 and 2, the enclosure for a voltage transformer comprises a shell 10, wherein the shell 10 is provided with three packaging spaces. These packaging spaces are used for packaging the bodies 30 of the voltage transformer. Each packaging space is provided with a closed end 122 and a sealed end 124. The voltage transformer is electrically connected to an external circuit through the closed ends 122 of the shell 10. In a schematic embodiment of the enclosure for a voltage transformer, a shell reinforcing rib 14 is arranged between every two adjacent packaging spaces, and the mechanical strength of the entire shell 10 can be enhanced by the shell reinforcing ribs 14, thereby enhancing the anti-explosion capability of the shell 10. These packaging spaces are arranged in a straight line along an arrangement direction D indicated by an arrow shown in the figure, and every two adjacent packaging spaces are in communication with each other. Although only three packaging spaces are shown in the figures, the number of the packaging spaces can be increased or decreased according to needs, and the number of the shell reinforcing ribs can be adjusted correspondingly.

The cover plate 20 can be sealingly connected to the sealed ends 124 of the packaging spaces such that the bodies 30 of the voltage transformer can be installed in the enclosure formed by the shell 10 and the cover plate 20. Since the packaging spaces provided in the enclosure for a voltage transformer are arranged in a straight line and every two adjacent packaging spaces are partitioned only by a shell reinforcing rib therebetween, the size of the enclosure for a voltage transformer along the arrangement direction D indicated by the arrow shown in the figures is reduced, as a result of which, the entire enclosure for a voltage transformer has a compact structure and a small occupied area.

As shown in FIG. 1, in a schematic embodiment of the enclosure for a voltage transformer, each shell reinforcing rib 14 is provided with a communicating hole 142. An insulating gas can flow between every two adjacent packaging spaces via the communicating holes 142; for example, an SF6 gas can flow among the packaging spaces to electrically insulate the bodies 30.

As shown in FIG. 1, in a schematic embodiment of the enclosure for a voltage transformer, the cover plate 20 is provided with two cover plate reinforcing ribs 22. These cover plate reinforcing ribs 22 correspond to the shell reinforcing ribs 14, i.e., the cover plate reinforcing ribs 22 are jointed with the shell reinforcing ribs 14. By providing the cover plate reinforcing ribs in the cover plate, the mechanical strength of the entire cover plate is enhanced, so that the anti-explosion capability of the cover plate is enhanced.

As shown in FIG. 1, in a schematic embodiment of the enclosure for a voltage transformer, the cover plate 20 is provided with a gas inlet 24, and the insulating gas introduced into the enclosure for a voltage transformer flows in via the gas inlet 24. In the entire enclosure for a voltage transformer, only one gas inlet and a plurality of communicating holes formed in the shell reinforcing ribs will suffice to realize control over the flow of the insulating gas in the entire enclosure for a voltage transformer, and consequently, the gas path structure of the insulating gas in the entire voltage transformer is greatly simplified, and thereby the usage of the insulating gas is reduced.

The present invention further provides a voltage transformer which, as shown in FIGS. 1 and 2, comprises an enclosure for a voltage transformer and three bodies 30, wherein the bodies 30 can be respectively contained in the packaging spaces. In a schematic embodiment of the voltage transformer, each of the bodies 30 is provided with a winding 32 and an iron core 34, the iron core being provided with an iron core post 342 and an iron yoke 344. The winding 32 can be installed on the iron core post 342, and the iron core post 342 can be connected to the iron yoke 344. Since the iron yoke 344 is of a sheet-shaped structure, the size of the iron yoke 344 is small along the arrangement direction D indicated by the arrow shown in the figures, and consequently, the size of the bodies 30 along the arrangement direction indicated by the arrow shown in the figures is reduced, so that the size of the enclosure for a voltage transformer for containing the bodies can be further reduced along the arrangement direction D indicated by the arrow shown in the figures.

Figure 3:
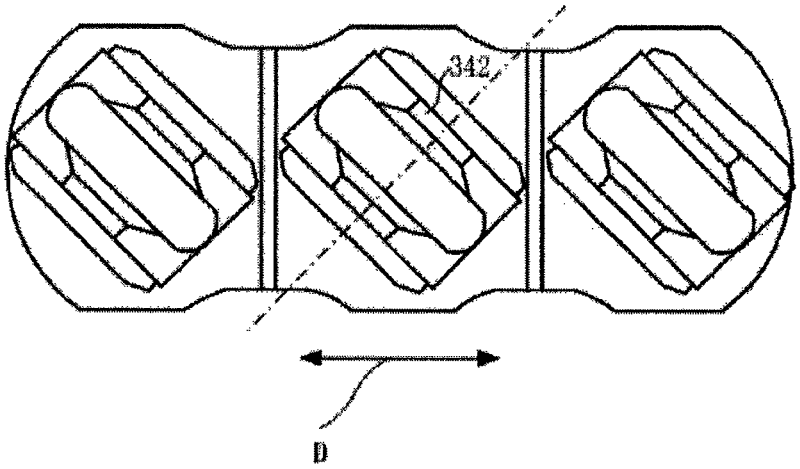
FIGS. 3 to 5 illustrate ways of installing the bodies of a voltage transformer.
Figure 4:
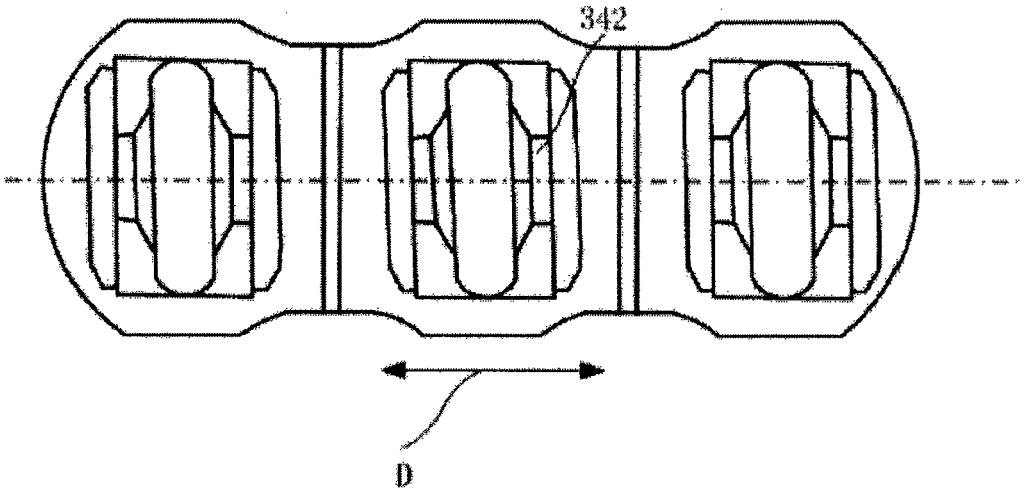
Figure 5:
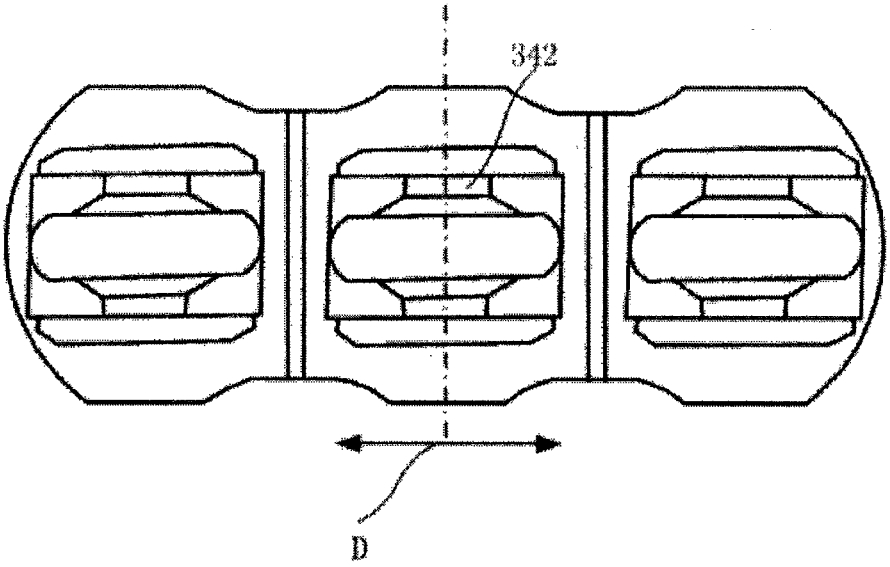

FIGS. 3 to 5 illustrate ways of installing the bodies of a voltage transformer. As shown in FIG. 3, the included angle between an extension direction of the iron core post 342 shown by a dotted line and the arrangement direction D indicated by the arrow in the drawing is 45 degrees. As shown in FIG. 4, the included angle between an extension direction of the iron core post 342 shown by a dotted line and the arrangement direction D indicated by the arrow in the drawing is 0 degrees. As shown in FIG. 5, the included angle between an extension direction of the iron core post 342 shown by a dotted line and the arrangement direction D indicated by the arrow in the drawing is 90 degrees. The included angle between an extension direction of the iron core post 342 and the arrangement direction D indicated by the arrow shown in the figure can also be other values according to needs, not being limited to the angles shown in FIGS. 3 to 5.

It should be understood that although the description has been described with reference to the various embodiments, it is not intended that every embodiment includes only one independent technical solution; this way of description is used only for sake of clarity, the description shall be regarded as a whole by those skilled in the art, and the technical solutions in all embodiments can also be properly combined to form other embodiments that may be understood by those skilled in the art.

DESCRIPTION OF REFERENCE NUMERALS

10 shell
122 closed end
124 sealed end
14 shell reinforcing rib
142 communicating hole
20 cover plate
22 cover plate reinforcing rib
24 gas inlet
30 bodies
32 winding
34 iron core
342 iron core post
344 iron yoke
D arrangement direction The detailed description set forth above is merely a specific description directed to the feasible embodiments of the present invention, and is not intended to limit the scope of protection of the present invention; and all equivalent embodiments or modifications, such as combinations, divisions and repetitions of the features, made without departing from the technical spirit of the present invention, shall be included in the scope of protection of the present invention.

The invention claimed is:

1. A voltage transformer, comprising:

an enclosure for a voltage transformer including a shell defining a plurality of packaging spaces for packaging bodies of the voltage transformer, each of said plurality of packaging spaces being further defined by a closed end, a sealed end and a shell reinforcing rib, every two adjacent packaging spaces of said plurality of packaging spaces being separated from an adjacent packaging space by the shell reinforcing rib, the shell reinforcing rib being in contact with and extending from the closed end to and in contact with the sealed end.

2. The voltage transformer of claim 1, wherein said packaging spaces are arranged in a straight line.

3. The voltage transformer of claim 2, wherein the shell reinforcing rib is arranged between every two of the adjacent packaging spaces of said packaging spaces.

4. The voltage transformer of claim 2, wherein said shell reinforcing rib is provided with a communicating hole for communicating the every two adjacent packaging spaces with each other.

5. The voltage transformer of claim 2, further comprising a cover plate, wherein said cover plate is sealingly connected to said sealed ends of said packaging spaces.

6. The voltage transformer of claim 5, wherein said cover plate is provided with a plurality of cover plate reinforcing ribs corresponding to a respective shell reinforcing rib, and wherein said cover plate reinforcing ribs are jointed with said shell reinforcing ribs.

7. The voltage transformer of claim 5, wherein said cover plate is provided with a gas inlet for introducing an insulating gas.

8. The voltage transformer of claim 6, wherein said cover plate is provided with a gas inlet for introducing an insulating gas.

9. The voltage transformer of claim 1, wherein said shell reinforcing rib defines a communicating hole for fluidly connecting at least one set of the every two adjacent packaging spaces with each other.

10. The voltage transformer of claim 1, further comprising a cover plate, wherein said cover plate is sealingly connected to the sealed end of said packaging spaces.

11. The voltage transformer of claim 10, wherein said cover plate is provided with a plurality of cover plate reinforcing ribs corresponding to said shell reinforcing ribs, wherein said cover plate reinforcing ribs are in contact with said shell reinforcing ribs.

12. The voltage transformer of claim 11, wherein said cover plate is provided with a gas inlet for introducing an insulating gas.

13. The voltage transformer of claim 10, wherein said cover plate is includes a gas inlet for introducing an insulating gas.

14. The voltage transformer of claim 1, wherein each of said packaging bodies includes a winding and an iron core, said iron core including an iron core post for mounting said winding and an iron yoke connected to said iron core post, said iron yoke being shaped like a sheet.

15. The voltage transformer of claim 14, wherein an included angle between an extension direction of said iron core post and an arrangement direction is 0, 90 or 45 degrees.

16. The voltage transformer of claim 15, wherein an included angle between an extension direction of said iron core post and said arrangement direction is 0, 90 or 45 degrees.

17. The voltage transformer of claim 14, wherein said voltage transformer is a three-phase voltage transformer.

18. The voltage transformer of claim 1, wherein said voltage transformer is a three-phase voltage transformer.

* * * * *